United States Patent [19]

Yoshida et al.

[11] Patent Number: 4,861,550

[45] Date of Patent: Aug. 29, 1989

[54] CORROSION-RESISTANT NICKEL-BASE ALLOY HAVING HIGH RESISTANCE TO STRESS CORROSION CRACKING

[75] Inventors: Takeshi Yoshida; Yoshio Takizawa, both of Urawa; Ichiro Sekine, Kitamoto, all of Japan

[73] Assignee: Mitsubishi Metal Corporation of Tokyo, Tokyo, Japan

[21] Appl. No.: 135,958

[22] Filed: Mar. 14, 1988

Related U.S. Application Data

[63] Continuation of Ser. No. 607,619, May 7, 1984, abandoned.

[30] Foreign Application Priority Data

Jul. 25, 1983 [JP] Japan ..... 58-135313
Jul. 25, 1983 [JP] Japan ..... 58-135314
Jul. 25, 1983 [JP] Japan ..... 58-135315

[51] Int. Cl.[4] ..... C22C 19/00

[52] U.S. Cl. ..... 420/460; 420/443; 420/445; 420/457

[58] Field of Search ..... 420/441, 443, 445, 457, 420/460; 148/428, 429

[56] References Cited

U.S. PATENT DOCUMENTS 2,959,480 11/1960 Flint ..... 420/460

*Primary Examiner*—R. Dean
*Attorney, Agent, or Firm*—Schmeiser, Morelle & Watts

[57] ABSTRACT

The invention relates to a Ni-base alloy which contains Mo, Al and Fe, and further, as required, one or more of the following: a group consisting of one or more of V, W, Cr and Cu; one or both of B and Ca; and Co. The alloy of the invention has excellent resistance to stress corrosion cracking even after being subjected to thermal processing such as welding without need for solution treatment thereafter.

7 Claims, No Drawings

CORROSION-RESISTANT NICKEL-BASE ALLOY HAVING HIGH RESISTANCE TO STRESS CORROSION CRACKING

This is a continuation of application Ser. No. 607,619 filed on May 7, 1984, abandonded.

BACKGROUND OF THE INVENTION

1. Technical

The invention relates to a corrosion-resistant alloy which shows high resistance to stress corrosion cracking even after being subjected to thermal processes such as welding without need for solution treatment thereafter.

2. Prior Arts

Hitherto, a Ni-base alloy containing 26–30% Mo has been generally used for fabricating structural members of reactor vessels, heat exchangers, chemical containers or the like used in chemical plants which are exposed to corrosive atmospheres containing reductive gas such as hydrofluoric gas, gaseous chloric acid or the like, or to non-oxidizing acids such as hydrochloric acid, sulfuric acid, phosphoric acid or the like, the Ni-base alloy showing high corrosion resistance to those corrosive atmospheres and non-oxidizing acids.

This corrosion-resistant Ni-base alloy of the prior art shows excellent properties in cold-working and welding as well as high corrosion resistance to corrosive atmospheres as mentioned above.

However, as can be understood from the binary phase diagram of a Ni-Mo group alloy, this corrosion-resistant Ni-base alloy of the prior art precipitates an inter-metallic compound of $Ni_4MO$ at temperatures of 600°–800° C. Since this inter-metallic compound causes a reduction of mechanical strength and ductility and the generation of stress corrosion cracking, the alloy of the prior art is normally applied after a solution treatment.

Therefore, even when the corrosion-resistant Ni-base alloy of the prior art is subjected to thermal process such as welding, the alloy is processed through a solution treatment to solve and dissipate the inter-metallic compound precipitated by the welding operation.

However, since the solution treatment to structural members after assembly by welding is limited due to structural and space restrictions and also due to the materials of the welded members, the area of application of the corrosion-resistive Ni-base alloy of the prior art has been limited to date.

SUMMARY OF THE INVENTION

An object of the invention is to provide a Ni-base alloy which, while maintaining excellent corrosion resistance, cold-workability and weldability, shows high resistance to stress corrosion cracking without precipitating any inter-metallic compounds even after being subjected to thermal processing.

Still another object of the invention is to provide a Ni-base alloy which does not necessitate solution treatment after, for instance, welding, and further does not induce any annealing cracks during strain-relief annealing after cold working since the alloy does not precipitate, any inter-metallic compounds, with the result that the alloy acquires such useful properties for industrial application that it becomes possible to apply the alloy in various areas where those properties are desired.

DISCLOSURE OF THE INVENTION

The inventors conducted research, for the reasons mentioned above, to obtain a material which does not show stress corrosion cracking even after being subjected to thermal processes such as welding, and consequently gained the knowledge that the Ni-base alloy which will be described below shows excellent corrosion resistance in corrosive environments where the alloy is exposed to the aforementioned corrosive atmospheres or non-oxidizing acids, has excellent cold-workability and weldability, especially does not precipitate any inter-metallic compounds after being subjected to thermal processes such as welding, therefore can be used even after being subjected to thermal processes without need for solution treatment thereafter.

The subject Ni-base alloy contains in weight percentage:

Mo 25–35%,
Al 2% or less,
Fe 8% or less;

further, as required, one or more of the following; a group consisting of one or more of V, W, Cr and Cu of 0.1–4.0%; one or both of B and Ca of 0.001–0.07%; and Co of 0.5–5%; the balance consisting of Ni and unavoidable impurities which contain C and Si, C being 0.1% or less and Si being 1% or less.

The present invention was made based on the research mentioned above. The reason for limiting the contents within the stated range will be described hereunder.

(a) Mo

Mo acts to form a solid solution in the base metal and remarkably improve corrosion resistance to corrosive atmospheres containing reductive gas or non-oxidizing acids, but if the content is less than 25%, the desired effect of the above-mentioned action is not obtained. On the contrary, if the content exceeds 35%, hot working properties and room temperature tenacity tend to be deteriorated. Thus the Mo content is specified as 25–35%.

(b) Al

Al content acts to form a solid solution in the base metal and reduce the oxygen content in the alloy to 0.006% (60 ppm) or less, prohibiting the precipitation of an inter-metallic compounds in the alloy which was heated to 600°–800° C., thereby improving resistance to stress corrosion cracking. However, if the Al content is less than 0.3%, the desired effect of the above-mentioned action is not obtained, while, on the contrary, if the content exceeds 2%, it tends not only to have the precipitation-preventive action for inter-metallic compounds saturated, but also to deteriorate the corrosion resistance in the aforementioned corrosive environments. Thus an Al content of 0.3–2.0% is desirable, but if Fe of 2–8% is contained, a smaller Al content does not drastically deteriorate the properties of the alloy, since Fe takes the place of Al.

(c) Fe

Fe also acts to form a solid solution in the base metal and prohibit the precipitation of intermetallic compounds when subjected to thermal processes such as welding, thereby improving resistance to stress corrosion cracking, but if the Fe content is less than 0.5%, a remarkable improvement in its resistance to stress corrosion cracking by its co-existence with Al can not be expected. On the contrary, if the content exceeds 8%, the corrosion resistance in the aforementioned corrosive environments tends to deteriorate in the same way that the Al content does. Further, if the Fe content exceeds 6% when the Al content is 0.3–2%, the deterioration of corrosion resistance appears, therefore an Fe content of 0.5–6.0% is desirable. However, when 0.3–2% Al is contained, a smaller Fe content does not drastically deteriorate the properties of the alloy since Al takes the place of Fe. On the other hand, when almost no Al content exists, the Fe content is desired to be 2–8%.

(d) V, W, Cr and Cu

These elements act, in addition to improving remarkably the corrosion resistance in the aforementioned corrosive environments, to prohibit the precipitation of inter-metallic compounds, remarkably improving the resistance to stress corrosion cracking thereby, and further increase the strength of the alloy. Therefore they are contained as required when those properties are desired. But if their content is less than 0.1%, the desired effect of the aforementioned action cannot be expected, and even if their content exceeds 4%, the remarkably improved effect of the aforementioned action is not obtained, therefore the content is specified as 0.1–4% from the point of view of economy.

(e) B and Ca

These elements, which have the extremely strong effect of prohibiting the precipitation of inter-metallic compounds, are contained when resistance to stress corrosion cracking is more highly desired. However, if their content is less than 0.001%, the desired resistance to stress corrosion cracking cannot be secured, but if the content exceeds 0.07%, the corrosion resistance in the aforementioned corrosive environments tends to deteriorate. Therefore their content is specified as 0.001–0.07%.

(f) Co

Since Co acts to increase the strength of the alloy without deteriorating the corrosion resistance and the resistance to stress corrosion cracking, it is contained as required when strength is especially desired. However, if the content is less than 0.5%, the desired improvement in strength is not obtained, while if the content exceeds 5%, the cold-working properties are deteriorated. Thus the content is specified as 0.5–5%.

(g) Unavoidable impurities

Among impurities, the contents of C and Si in particular must be 0.1% or less and 1% or less, respectively. If the C content exceeds 0.1%, Mo is consumed as molybdenum carbide and a Mo-lacking layer tends to form between grains, and consequently deteriorates the resistance to intergranular corrosion. On the other hand, Si element acts to promote degassing and improve fluidity of molten metal, therefore being a useful element for producing sound cast block, but if its content exceeds 1%, it tends to remarkably promote the formation of molybdenum carbide. Therefore the upper limits of 0.1% and 1%, respectively, for C and Si contents must not be exceeded. Furthermore, when the alloy is to be used under severe conditions where the temperature of the corrosive environment is high or the concentration of reductive gas or non-oxidizing acid is high, the upper limits of the C and Si contents need to be 0.02 and 0.1%, respectively.

Further P, S, Mg, Mn and the like may be contained as other impurities, but if the contents are as low as 0.05% or less of P, 0.05% or less of S, 0.1% or less of Mg, and 2.5% or less of Mn, then the alloy properties are not deteriorated at all, but since Mg and Mn act to promote degassing of the alloy and prohibit the harmful actions of P and S elements, there are cases where the P and S contents under the aforementioned upper limits are deliberately included.

Still further, if one or more elements among Ti, Zr, Nb and Y are added to the alloy in such amounts as 0.05–0.5% of Ti, 0.05–0.5% of Zr, 0.05–0.5% of Nb and 0.005–0.1% of Y, then these elements combine with the solid solution of C to form the carbides thereof. Since these carbides are dispersed and precipitated in the crystallized grains, the precipitation of carbides between grains are prevented, thereby improving the resistance to intergranular corrosion accordingly.

DESCRIPTION OF EMBODIMENTS

The Ni-base alloy according to the invention will now be described on the basis of examples.

EXAMPLE 1

Ni-base alloy No. 1 through No. 36 according to the present invention and the Ni-base alloy of the prior art containing the composition shown in Table 1 were molten and cast through the normal VIM+ESR double melt method, thereafter were made into hot-rolled plates of 3 mm thickness by hot-forging and hot-rolling under normal conditions, following which a solution heat-treatment was applied by quenching with water after heating the hot-rolled plates at a temperature of 1066° C. for 30 minutes.

Next, plate tensile test specimens having a length of the parallel portion of 20 mm, a width of the parallel portion of 4 mm and a thickness of 2 mm were fabricated through machining from the hot-rolled plates of the alloys No. 1 through No. 36 of the invention and the alloy of the prior art thus obtained. The test specimens were subjected thereafter to the aging heat-treatment, first at 750° C. for 15 minutes and further for 60 minutes at the same temperature, and the test specimens were submerged in a solution of $N_2$ purged 1:1 solution of acetone and alcohol containing 0.5% $H_2SO_4$ and 0.5% HCl placed in a static autoclave of 4.5 l capacity, and subjected to slow strain rate ture of 150° C. and at a straining rate of $8.3\times10^{-7}$/sec. The fracture surfaces were observed after the tests, and the ratio of area broken due to stress corrosion cracking (intergranular cracking) against the whole area of specimen, i.e. the area ratio, was computed. Therefore the large the area ratio of stress corrosion cracking surface, the less resistance to stress corrosion cracking.

In the same manner, test specimens having a width of 25 mm, a length of 50 mm and a thickness of were fabricated through machining from the hot-rolled plates of the alloys No. 1 through No. 36 of the invention and the alloy of the prior art, and subjected to corrosion tests by being submerged in a boiling solution of 20% HCl for 96 hours in an autoclave. The weight loss was measured after the tests and converted into annual rates, the results being shown in Table 1.

From the results shown in Table 1, it is clear that the alloys No. 1 through No. 36 of the present invention show excellent resistance to stress corrosion cracking even after being subjected to thermal processing at 750° C., and are also excellent in corrosion resistance, but that the Ni-base alloy of the prior art is much inferior to the alloys of the present invention in resistance to stress corrosion cracking.

EXAMPLE 2

The nickel-base alloys No. 1 through No. 23 of the invention and the Ni-base alloy of the prior art having the compositions shown in Table 2 were molten and cast through the normal VIM+ESR double melt method, and thereafter fabricated into hot-rolled plates of 3 mm thickness through hot-forging and hot-rolling. Following that process, the hot-rolled plates were solution heat-treated by water quenching after being heated at a temperature of 1066° C. for 30 minutes.

TABLE 1

| Classification of Alloy | | Composition (Weight %) Mo | Al | Fe | V | W | Cr | Cu | B | Ca | Co | C | Si | Ni plus Impurities | Area Ratio to Fracture Surface due to Stress Corrosion Cracking (%) Unavoidable 15 min | 60 min | Corrosion Rate Other (mm/Y) |
|---|---|---|---|---|---|---|---|---|---|---|---|---|---|---|---|---|---|
| Ni—base Alloy of the Invention | 1 | 25.3 | 0.41 | 1.23 | — | — | — | — | — | — | — | 0.021 | 0.14 | Balance | 0.0 | 7.4 | 0.52 |
| | 2 | 30.2 | 0.52 | 2.20 | — | — | — | — | — | — | — | 0.0320 | 0.32 | Balance | 0.0 | 8.2 | 0.47 |
| | 3 | 34.6 | 0.37 | 1.40 | — | — | — | — | — | — | — | 0.013 | 0.25 | Balance | 0.0 | 8.5 | 0.43 |
| | 4 | 27.5 | 0.32 | 1.66 | — | — | — | — | — | — | — | 0.004 | 0.03 | Balance | 0.0 | 8.4 | 0.41 |
| | 5 | 26.3 | 1.99 | 2.43 | — | — | — | — | — | — | — | 0.003 | 0.02 | Balance | 0.0 | 7.6 | 0.42 |
| | 6 | 28.2 | 0.52 | 0.54 | — | — | — | — | — | — | — | 0.004 | 0.01 | Balance | 0.0 | 8.3 | 0.41 |
| | 7 | 27.1 | 0.62 | 5.93 | — | — | — | — | — | — | — | 0.003 | 0.02 | Balance | 0.0 | 7.7 | 0.42 |
| | 8 | 28.2 | 0.55 | 1.94 | 0.12 | — | — | — | — | — | — | 0.033 | 0.13 | Balance | 0.0 | 6.5 | 0.41 |
| | 9 | 26.7 | 0.38 | 1.58 | — | 1.96 | — | — | — | — | — | 0.012 | 0.15 | Balance | 0.0 | 6.8 | 0.38 |
| | 10 | 27.2 | 0.37 | 1.92 | — | — | 1.03 | — | — | — | — | 0.025 | 0.22 | Balance | 0.0 | 6.7 | 0.36 |
| | 11 | 27.5 | 0.45 | 1.34 | — | — | — | 1.56 | — | — | — | 0.016 | 0.23 | Balance | 0.0 | 6.6 | 0.39 |
| | 12 | 27.3 | 0.88 | 1.25 | 1.21 | — | — | 0.14 | — | — | — | 0.023 | 0.14 | Balance | 0.0 | 6.3 | 0.35 |
| | 13 | 28.2 | 0.63 | 2.35 | — | 1.85 | 0.32 | — | — | — | — | 0.034 | 0.23 | Balance | 0.0 | 6.2 | 0.34 |
| | 14 | 27.4 | 0.57 | 1.21 | 0.59 | 0.96 | 0.87 | 0.46 | — | — | — | 0.025 | 0.16 | Balance | 0.0 | 5.7 | 0.33 |
| | 15 | 26.9 | 0.53 | 1.32 | — | — | — | — | 0.0013 | — | — | 0.005 | 0.01 | Balance | 0.0 | 4.8 | 0.50 |
| | 16 | 27.5 | 0.62 | 2.10 | — | — | — | — | 0.0091 | — | — | 0.006 | 0.08 | Balance | 0.0 | 4.5 | 0.48 |
| | 17 | 27.2 | 0.42 | 1.54 | — | — | — | — | — | 0.0012 | — | 0.007 | 0.03 | Balance | 0.0 | 4.9 | 0.49 |
| | 18 | 28.1 | 0.47 | 1.03 | — | — | — | — | — | 0.0321 | — | 0.006 | 0.06 | Balance | 0.0 | 4.7 | 0.47 |
| | 19 | 27.6 | 0.52 | 0.92 | — | — | — | — | — | 0.0542 | — | 0.004 | 0.07 | Balance | 0.0 | 4.6 | 0.49 |
| | 20 | 27.3 | 0.63 | 1.54 | — | — | — | — | 0.0041 | 0.0246 | — | 0.005 | 0.06 | Balance | 0.0 | 3.7 | 0.52 |
| | 21 | 27.2 | 0.78 | 2.31 | — | — | — | — | — | — | 0.53 | 0.027 | 0.14 | Balance | 0.0 | 8.2 | 0.48 |
| | 22 | 28.3 | 0.45 | 1.62 | — | — | — | — | — | — | 2.76 | 0.013 | 0.24 | Balance | 0.0 | 8.3 | 0.49 |
| | 23 | 26.8 | 0.36 | 2.51 | — | — | — | — | — | — | 4.96 | 0.014 | 0.16 | Balance | 0.0 | 8.5 | 0.51 |
| | 24 | 28.5 | 0.85 | 1.25 | — | 0.86 | — | — | 0.0034 | — | — | 0.032 | 0.23 | Balance | 0.0 | 4.6 | 0.37 |
| | 25 | 29.2 | 1.02 | 1.10 | — | — | 1.32 | 1.09 | — | 0.0382 | — | 0.011 | 0.25 | Balance | 0.0 | 4.5 | 0.35 |
| | 26 | 26.7 | 0.96 | 2.20 | 0.83 | 0.32 | — | — | 0.0029 | 0.0041 | — | 0.013 | 0.23 | Balance | 0.0 | 0.37 | |
| | | | | | | | | | | | | | | | 4.5 | | |
| | 27 | 28.3 | 0.54 | 2.11 | — | 1.96 | 0.19 | — | — | — | 2.03 | 0.025 | 0.11 | Balance | 0.0 | 4.6 | 0.36 |
| | 28 | 26.8 | 0.77 | 1.03 | 0.29 | — | — | 0.25 | — | — | 3.21 | 0.036 | 0.15 | Balance | 0.0 | 4.7 | 0.36 |
| | 29 | 28.8 | 0.56 | 1.02 | — | — | — | 0.0086 | — | 1.56 | 0.024 | 0.13 | Balance | 0.0 | 4.3 | 0.44 | |
| | 30 | 27.3 | 0.42 | 1.22 | — | — | — | — | — | 0.0431 | 0.94 | 0.032 | 0.25 | Balance | 0.0 | 4.3 | 0.48 |
| | 31 | 27.6 | 0.66 | 1.45 | — | — | — | — | 0.0036 | 0.0094 | 0.73 | 0.013 | 0.34 | Balance | 0.0 | 3.7 | 0.49 |
| | 32 | 26.8 | 0.63 | 1.32 | — | 0.64 | — | — | 0.0021 | — | 0.99 | 0.017 | 0.26 | Balance | 0.0 | 3.6 | 0.38 |
| | 33 | 27.5 | 0.71 | 1.15 | 0.24 | — | — | — | — | 0.0321 | 1.73 | 0.016 | 0.21 | Balance | 0.0 | 3.5 | 0.40 |
| | 34 | 28.4 | 0.38 | 2.16 | — | — | 1.98 | — | — | 0.0567 | 3.21 | 0.034 | 0.10 | Balance | 0.0 | 3.6 | 0.37 |
| | 35 | 28.7 | 0.82 | 2.11 | — | 1.03 | 0.52 | 0.31 | 0.0089 | — | 2.04 | 0.032 | 0.06 | Balance | 0.0 | 3.2 | 0.36 |
| | 36 | 26.9 | 0.64 | 1.31 | 0.58 | 0.64 | 0.37 | 0.49 | 0.0054 | 0.0424 | 1.54 | 0.013 | 0.22 | Balance | 0.0 | 2.1 | 0.32 |
| Ni—base alloy of prior art | | 28.3 | 0.17 | 0.24 | — | — | — | — | — | — | — | 0.004 | 0.03 | Balance | 37.2 | 100 | 0.39 |

Next, the plate tensile test specimens having a length of the parallel portion of 20 mm, a width of the parallel portion of 4 mm and a thickness of 2 mm were fabricated through machining from the hot-rolled plates of the Ni-base alloy of the invention and the Ni-base alloy of the prior art thus obtained. These test specimens were subjected thereafter to aging heat treatment at a temperature of 750° C. for 30 minutes, and the test specimens were submerged in $N_2$ purged 1:1 solution of acetone and alcohol containing 0.5% $H_2SO_4$ and 0.5% HCl placed in a static autoclave having a capacity of 4.5 l, and subjected to slow strain rate stress corrosion cracking tests at a solution temperature of 150° C. and a straining rate of $8.3\times10^{-7}$/sec. The fracture surfaces were observed after the tests, and the ratio of area of surface fractured due to stress corrosion cracking (intergranular breakage) against the whole area of specimen, i.e. the area ratio, was computed. Therefore, the larger the area ratio of surface cracked due to stress corrosion, the less resistance to stress corrosion cracking.

In the same manner, two test specimens having a width of 70 mm, a length of 150 mm and a thickness of 3 mm were fabricated through machining from the hot-rolled plates of each of the Ni-base alloys No. 1 through No. 23 of the invention and the Ni-base alloy of the prior art, and butt-welded together along their length by TIG welding. Thereafter test pieces having a width of 25 mm and a length of 50 mm were cut out therefrom with the welds positioned in their center. The test pieces were subjected to intergranular corrosion tests by submerging them in a 20% HCl solution at 150° C. for 100 hours. After testing, the maximum depths of corrosion attach in the welding heat-affected zones were measured, the results being shown in Table 2.

From the results shown in Table 2 it is clear that the Ni-base alloys No. 1 through No. 23 of the invention show excellent resistance to stress corrosion cracking even after being subjected to thermal processing at 750°

C. and are also excellent in corrosion resistance, but that the Ni-base alloy of the prior art is much inferior to the Ni-base alloys of the invention in resistance to stress corrosion cracking.

EXAMPLE 3

The Ni-base alloys No. 1 through No. 23 of the invention and the Ni-base alloy of the prior art having the compositions shown in Table 2 were molten and cast through the normal VIM+ESR double melt method, and fabricated into hot-rolled plates of 3 mm thickness through hot-forging and hot-rolling. Following that process, the hot-rolled plates were subjected to solution heat-treatment by water quenching after heating at 1066° C. for 30 minutes.

In the same manner, test specimens having a width of 70 mm, a length of 150 mm and a thickness of 3 mm were fabricated through machining from the hot-rolled plates of each of the Ni-base alloys No. 1 through No. 23 of the invention and the Ni-base alloy of the prior art, and butt-welded together along their length of TIG welding. Thereafter test pieces having a width of 25 mm and a length of 50 mm were cut out therefrom with the welds positioned in their center. The test pieces were subjected to intergranular corrosion tests by submerging them in a water 20% HCl solution at 150° C. for 100 hours. After testing, the maximum depths of corrosion attach in the welding heat-affected zones were measured, the results being shown in Table 3.

From the results shown in Table 3 it is clear that

TABLE 2

| Classification of Alloy | | Composition (Weight %) Mo | Al | V | W | Cr | Cu | B | Ca | Ca | Unavoidable impurities C | Si | Ni plus Other Impurities | Area Ratio of Fracture Surface due to stress Corrosion Cracking (%) | Maximum Depth of Corrosion Attack in Welding Heat-affected zone (mm) |
|---|---|---|---|---|---|---|---|---|---|---|---|---|---|---|---|
| Ni—base | 1 | 25.3 | 0.63 | — | — | — | — | — | — | — | 0.012 | 0.073 | Balance | 2.4 | 0.04 |
| | 2 | 30.8 | 0.58 | — | — | — | — | — | — | — | 0.014 | 0.062 | Balance | 2.8 | 0.04 |
| Alloy | 3 | 34.6 | 0.59 | — | — | — | — | — | — | — | 0.016 | 0.045 | Balance | 2.9 | 0.03 |
| | 4 | 28.3 | 0.31 | — | — | — | — | — | — | — | 0.007 | 0.042 | Balance | 2.3 | 0.03 |
| of the | 5 | 28.6 | 1.97 | — | — | — | — | — | — | — | 0.006 | 0.053 | Balance | 2.2 | 0.03 |
| | 6 | 28.2 | 0.73 | 0.12 | — | — | — | — | — | — | 0.008 | 0.037 | Balance | 2.1 | 0.02 |
| Invention | 7 | 28.5 | 0.74 | — | 1.94 | — | — | — | — | — | 0.007 | 0.036 | Balance | 1.9 | 0.02 |
| | 8 | 27.9 | 0.76 | — | — | 1.85 | — | — | — | — | 0.008 | 0.042 | Balance | 1.9 | 0.02 |
| | 9 | 27.6 | 0.72 | — | — | — | 1.03 | — | — | — | 0.006 | 0.035 | Balance | 2.0 | 0.02 |
| | 10 | 28.3 | 0.76 | 1.23 | 0.13 | — | — | — | — | — | 0.009 | 0.036 | Balance | 1.6 | 0.01 |
| | 11 | 28.4 | 0.72 | — | 1.03 | — | 0.15 | — | — | — | 0.008 | 0.035 | Balance | 1.7 | 0.01 |
| | 12 | 28.2 | 0.76 | 1.90 | — | 0.54 | 0.94 | — | — | — | 0.008 | 0.043 | Balance | 1.6 | 0.01 |
| | 13 | 28.3 | 0.56 | — | — | — | — | 0.0013 | — | — | 0.004 | 0.048 | Balance | 1.3 | 0.03 |
| | 14 | 28.5 | 0.61 | — | — | — | — | 0.0061 | — | — | 0.004 | 0.039 | Balance | 1.0 | 0.04 |
| | 15 | 27.2 | 0.58 | — | — | — | — | — | 0.0014 | — | 0.005 | 0.038 | Balance | 1.4 | 0.03 |
| | 16 | 27.4 | 0.53 | — | — | — | — | — | 0.0512 | — | 0.004 | 0.039 | Balance | 1.1 | 0.04 |
| | 17 | 28.4 | 0.81 | — | — | — | — | — | — | 0.59 | 0.011 | 0.069 | Balance | 2.8 | 0.03 |
| | 18 | 27.9 | 0.82 | — | — | — | — | — | — | 4.12 | 0.010 | 0.073 | Balance | 2.6 | 0.03 |
| | 19 | 27.8 | 0.45 | — | — | 0.85 | — | 0.0324 | 0.0324 | — | 0.004 | 0.056 | Balance | 1.0 | 0.02 |
| | 20 | 27.7 | 0.42 | 0.63 | — | — | — | — | — | 1.89 | 0.008 | 0.053 | Balance | 1.8 | 0.02 |
| | 21 | 26.9 | 0.46 | — | 1.04 | — | 1.86 | — | — | 2.54 | 0.007 | 0.052 | Balance | 1.5 | 0.01 |
| | 22 | 27.3 | 0.47 | — | — | — | — | 0.0054 | — | 1.23 | 0.008 | 0.063 | Balance | 1.1 | 0.04 |
| | 23 | 28.2 | 0.44 | 0.32 | 0.54 | 0.96 | 0.84 | 0.0024 | 0.0126 | 0.96 | 0.009 | 0.045 | Balance | 0.9 | 0.01 |
| Ni—base Alloy of Prior Art | | 27.3 | 0.11 | — | — | — | — | — | — | — | 0.007 | 0.040 | Balance | 92.3 | 0.03 |

Next plate tensile test specimens having a length of the parallel portion of 20 mm, a width of the parallel portion of 4 mm and a thickness of 2 mm were fabricated through machining from the hot-rolled plates of the Ni-base alloys of the invention and the Ni-base alloy of the prior art thus obtained. These test specimens were subjected thereafter to aging heat treatment at 750° C. for 30 minutes, and the test specimens were submerged in a $N_2$ purged 1:1 solution acetone and alcohol containing 0.5% $H_2SO_4$ and 0.5 HCl placed in a static autoclave having a capacity of 4.5 l, and subjected to slow strain late stress corrosion cracking tests at a solution temperature of 150° C. and a straining rate of $8.3\times10^{-7}$/sec. The fracture surfaces were observed after the tests and the ratio cracking (intergranular cracking) against the whole surface area of specimen, i.e. the area ratio, was computed. Therefore, the larger the area ratio of surface fracture due to stress corrosion cracking, the less resistance to stress corrosion cracking.

Ni-base alloys No. 1 through No. 23 of the invention show excellent resistance to stress corrosion cracking even after being subjected to thermal processing at 750° C. and are also excellent in corrosion resistance, but that the Ni-base alloy of the prior art is much inferior to the Ni-base alloys of the invention in resistance to stress corrosion cracking.

As heretofore mentioned, the Ni-base alloy of the present invention show high resistance to stress corrosion cracking without precipitating any intermetallic compound even after being subjected to thermal processing while maintaining excellent corrosion resistance, cold-workability and weldability, therefore does not necessitate solution treatment after, for instance, welding, and further does not induce any annealing crack during strain-relief annealing after cold working since the alloy does not precipitate any inter-metallic compound, with the result that the alloy has such useful properties for industrial application that it becomes possible to apply the alloy in various areas where those properties are desired.

TABLE 3

| Classification of Alloy | | Composition (Weight %) Mo | Al | V | W | Cr | Cu | B | Ca | Co | Unavoidable impurities C | Si | Ni plus Other Impurities | Area Ratio of Fracture Surface due to Stress Corrosion Cracking (%) | Maximum Depth of Corrosion in Welding Heat-affected zone (mm) |
|---|---|---|---|---|---|---|---|---|---|---|---|---|---|---|---|
| Ni—base | 1 | 25.6 | 4.3 | — | — | — | — | — | — | — | 0.008 | 0.072 | Balance | 0.9 | 0.04 |
| | 2 | 31.2 | 4.7 | — | — | — | — | — | — | — | 0.007 | 0.081 | Balance | 1.0 | 0.04 |
| Alloy | 3 | 34.8 | 3.2 | — | — | — | — | — | — | — | 0.008 | 0.046 | Balance | 1.3 | 0.03 |
| | 4 | 27.3 | 2.2 | — | — | — | — | — | — | — | 0.006 | 0.043 | Balance | 1.7 | 0.04 |
| of the | 5 | 27.9 | 7.9 | — | — | — | — | — | — | — | 0.008 | 0.051 | Balance | 1.4 | 0.05 |
| | 6 | 28.3 | 4.8 | 1.04 | — | — | — | — | — | — | 0.007 | 0.034 | Balance | 0.8 | 0.02 |
| Invention | 7 | 28.5 | 5.3 | — | 1.96 | — | — | — | — | — | 0.006 | 0.035 | Balance | 0.9 | 0.02 |
| | 8 | 29.1 | 5.2 | — | — | 0.86 | — | — | — | — | 0.007 | 0.041 | Balance | 0.8 | 0.02 |
| | 9 | 28.7 | 5.3 | — | — | — | 0.12 | — | — | — | 0.007 | 0.038 | Balance | 0.9 | 0.02 |
| | 10 | 28.2 | 4.9 | 0.12 | — | — | 0.31 | — | — | — | 0.008 | 0.037 | Balance | 0.8 | 0.01 |
| | 11 | 27.9 | 4.3 | — | 0.68 | 0.32 | — | — | — | — | 0.008 | 0.043 | Balance | 0.7 | 0.01 |
| | 12 | 29.2 | 4.2 | 0.59 | 0.66 | — | 0.83 | — | — | — | 0.006 | 0.051 | Balance | 0.6 | 0.01 |
| | 13 | 28.3 | 4.1 | — | — | — | — | 0.0015 | — | — | 0.003 | 0.038 | Balance | 0.5 | 0.03 |
| | 14 | 28.2 | 4.5 | — | — | — | — | — | 0.0018 | — | 0.003 | 0.039 | Balance | 0.5 | 0.04 |
| | 15 | 28.3 | 5.2 | — | — | — | — | — | 0.0594 | — | 0.004 | 0.034 | Balance | 0.5 | 0.06 |
| | 16 | 28.2 | 5.6 | — | — | — | — | 0.0038 | 0.0324 | — | 0.003 | 0.042 | Balance | 0.4 | 0.06 |
| | 17 | 26.3 | 5.8 | — | — | — | — | — | — | 0.54 | 0.008 | 0.070 | Balance | 1.6 | 0.03 |
| | 18 | 26.7 | 5.6 | — | — | — | — | — | — | 4.92 | 0.007 | 0.068 | Balance | 1.8 | 0.02 |
| | 19 | 27.2 | 5.4 | — | 0.15 | — | 0.58 | 0.0094 | — | — | 0.006 | 0.045 | Balance | 0.4 | 0.03 |
| | 20 | 27.3 | 5.3 | — | — | 0.98 | — | — | 0.0591 | — | 0.005 | 0.053 | Balance | 0.5 | 0.04 |
| | 21 | 27.5 | 5.6 | 1.13 | — | — | — | — | — | 1.58 | 0.005 | 0.052 | Balance | 0.6 | 0.03 |
| | 22 | 27.2 | 5.7 | — | — | 0.25 | 1.86 | — | — | 0.99 | 0.006 | 0.048 | Balance | 0.5 | 0.02 |
| | 23 | 26.4 | 5.6 | 0.36 | 0.42 | 0.31 | 0.26 | 0.0320 | 0.0046 | 3.61 | 0.007 | 0.066 | Balance | 0.3 | 0.01 |
| Ni—base Alloy of Prior Art | | 27.3 | 0.3 | — | — | — | — | — | — | — | 0.004 | 0.038 | Balance | 63.5 | 0.03 |

We claim:

1. A corrosion-resistant Ni-base alloy having high resistance to stress corrosion cracking and consisting of, by weight: 25–35% Mo, 0.3–2% Al, 0.1–4% of at least one of the elements W, Cr and Cu, balance Ni and incidental impurities including up to 0.02% C and up to 0.1% Si.

2. A corrosion-resistant Ni-base alloy having high resistance to stress corrosion cracking and consisting of, by weight: 25–35% M, 0.3–2% Al, 0.001–0.07% of at least one of the elements B and Ca, balance Ni and incidental impurities including up to 0/02% C and up to 0.1% Si.

3. A corrosion-resistant Ni-Base alloy having high resistance to stress corrosion cracking and consisting of, by weight: 25–35% Mo, 0.3–2% Al, 0.05–5% Co, balance Ni and incidental impurities including up to 0.02% C and up to 0.1% Si.

4. A corrosion-resistant Ni-base alloy having high resistance to stress corrosion cracking and consisting of, by weight: 25–35% Mo, 0.3–2% Al, 0.1–4% of at least one of the elements W, Cr and Cu, 0.001–0.07% of at least one of the elements B and Ca, balance Ni and incidental impurities including up to 0.02% C and up to 0.1% Si.

5. A corrosion-resistant Ni-base alloy having high resistance to stress corrosion cracking and consisting of, by weight: 25–35% Mo, 0.3–2% Al, 0.1–4% of at least one of the elements W, Cr and Cu, 0.5–5% Co, balance Ni and incidental impurities including up to 0.02% C and up to 0.1% Si.

6. A corrosion-resistant Ni-base alloy having high resistance to stress corrosion cracking and consisting of, by weight: 25–35% Mo, 0.3–2% Al, 0.5–5% Co, 0.001–0.07% of at least one of the elements B and Ca, balance Ni and incidental impurities including up to 0.02% C and up to 0.1% Si.

7. A corrosion-resistant Ni-base alloy having high resistance to stress corrosion cracking and consisting of, by weight: 25–35% Mo. 0.3–2% Al, 0.1–4% of at least one of the elements W, Cr and Cu, 0.5–5% Co, 0.001–0.07% of at least one of the elements b and Ca, balance Ni and incidental impurities including up to 0.02% C and up to 0.1% Si.

* * * * *